US006537086B1

(12) United States Patent
Mac Mullin

(10) Patent No.: US 6,537,086 B1
(45) Date of Patent: Mar. 25, 2003

(54) HIGH SPEED TRANSMISSION ELECTRICAL CONNECTOR WITH IMPROVED CONDUCTIVE CONTACT

(75) Inventor: Robert Mac Mullin, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/978,157

(22) Filed: Oct. 15, 2001

(51) Int. Cl.[7] ..... H01R 1/00
(52) U.S. Cl. ..... 439/79; 439/607; 439/609
(58) Field of Search ..... 439/79, 80, 83, 439/62, 607, 609

(56) References Cited

U.S. PATENT DOCUMENTS 5,238,412 A * 8/1993 Morishita et al. ..... 439/79
5,651,685 A * 7/1997 Brinkman et al. ..... 439/79
5,882,214 A * 3/1999 Hillbish et al. ..... 439/79
6,210,224 B1 * 4/2001 Wu ..... 439/607

* cited by examiner

*Primary Examiner*—P. Austin Bradley
*Assistant Examiner*—Alexander Gilman
(74) *Attorney, Agent, or Firm*—Wei Te Chung

(57) ABSTRACT

A high speed transmission electrical connector (1) comprises a dielectric body (10), a plurality of signal contact units (30) and grounding contacts (20) alternately retained in the dielectric body. Each signal contact unit has a differential pair of upper and lower contacts (32, 34) separated from each other for transmitting differential signals between an electrical component and a circuit board. Each upper or lower contact comprises a retaining body (322, 342), a resilient beam (324, 344) and a soldering portion (328, 348) extending from opposite ends of the retaining body, respectively. The retaining body of the lower contact defines a cutout (340) in an upper side (341) thereof adjacent to the upper contact. The cutout is like an inverted funnel in cross section for eliminating electrical skew between the upper and lower contacts and therefore maintaining system impedance.

17 Claims, 10 Drawing Sheets

HIGH SPEED TRANSMISSION ELECTRICAL CONNECTOR WITH IMPROVED CONDUCTIVE CONTACT

BACKGROUND OF THE INVENTION

1. Field of the Invention

The present invention relates to a high speed transmission electrical connector, and particularly to such a connector with improved conductive contacts.

2. Description of Prior Art

With the development in computer and communication technologies, high speed transmission electrical connectors, such as Infiniband, backplane, serial ATA and so on, are used more and more by industry business. At the same time, differential signal transmission systems are used for such high speed transmission connectors since they offer signal transmission with relatively low voltage swings and good noise rejection. Thus, a high speed transmission connector commonly comprises a plurality of differential pairs of conductive contacts for transmitting high speed and high frequency differential signals between an electrical component and a circuit board. However, each differential pair has an upper and a lower conductive contacts which are separated from each other, wherein the lower contact is shorter than the upper contact in its whole length, thereby causing electrical skew between the upper and lower contacts and thus resulting in propagation delay. Particularly in high speed systems, the effect of propagation delay is detrimental to signal integrity. On the other hand, the system impedance due to design variation of either the upper or the lower contact of the differential pair must still be maintained for reliable signal transmission.

Accordingly, the present invention is intended to provide a high speed transmission electrical connector having a plurality of differential pairs of conductive contacts which can meet the electrical skew and impedance control requirements, simultaneously.

BRIEF SUMMARY OF THE INVENTION

A main object of the present invention is to provide a high speed transmission electrical connector having a plurality of differential pairs of signal contacts which can meet not only electrical skew but also impedance control requirements.

An electrical connector in accordance with the present invention is used for transmitting high speed signals between an electrical component and a circuit board. The electrical connector comprises a dielectric body defining a plurality of passageways, a plurality of signal contact units and grounding contacts alternatively retained in the passageways. Each signal contact unit has a differential pair of upper and lower contacts separated from each other, wherein the lower contact is shorter than the upper contact in whole length thereof. Each of the upper and lower contacts comprises a retaining body, a resilient beam to be mated with the electrical connector and a soldering portion to be soldered to the circuit board extending from opposite ends of the retaining body, respectively. The retaining body of the lower contact defines a cutout like an inverted funnel in cross section at an upper side thereof adjacent to the upper contact.

Other objects, advantages and novel features of the invention will become more apparent from the following detailed description of the present embodiment when taken in conjunction with the accompanying drawings.

DETAILED DESCRIPTION OF THE INVENTION

Figure 1:
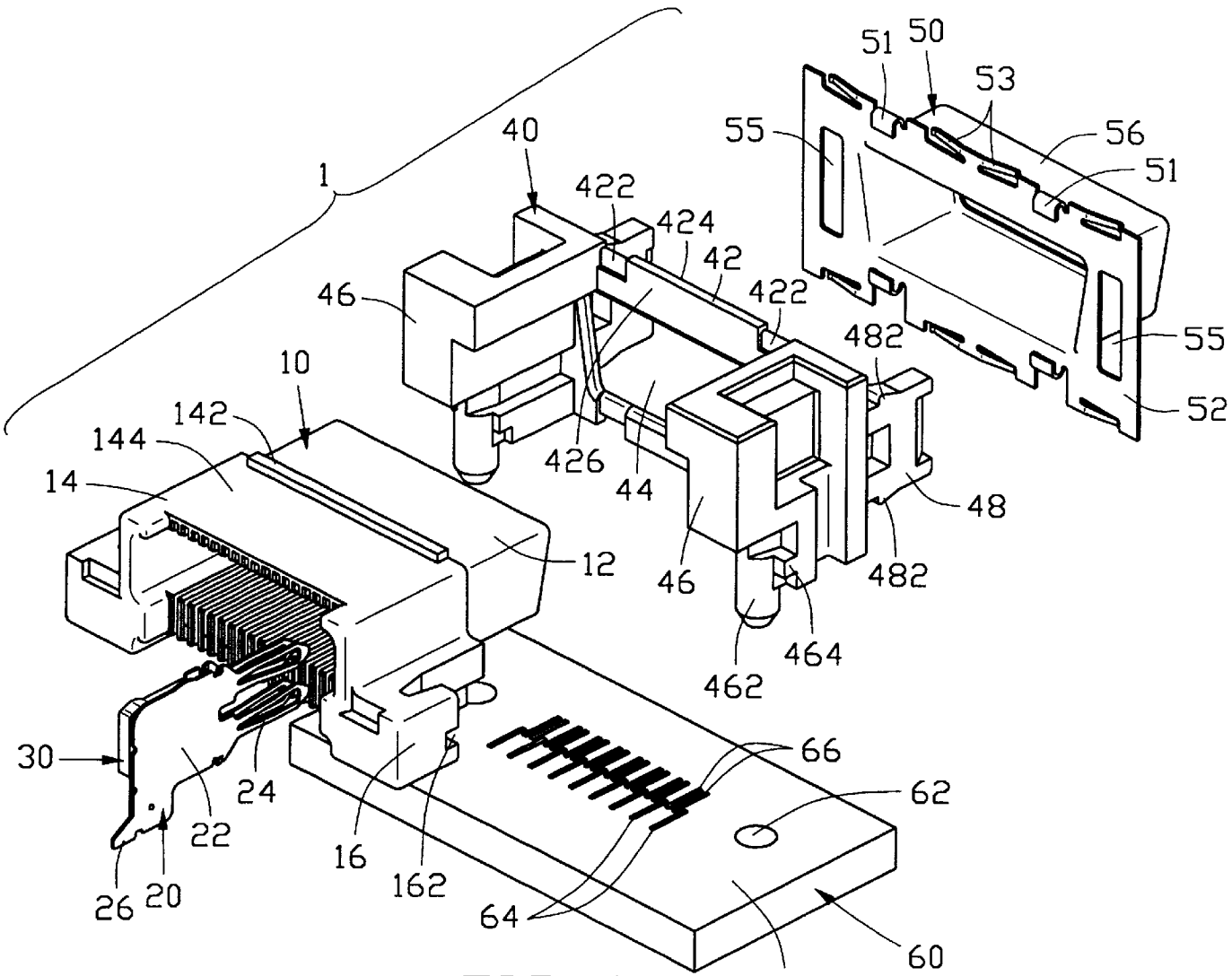
FIG. 1 is an exploded perspective view of an electrical connector in accordance with the present invention.

Reference will now be made to the drawings, and firstly to FIG. 1. A high speed transmission electrical connector 1 in accordance with the present invention is used for being mounted on a circuit board 60. The electrical connector 1 includes a dielectric body 10, a plurality of grounding contacts 20 (only one shown) and a plurality of signal contact units 30 (only one shown) alternately retained in the dielectric body 10, a frame member 40 and a conductive shield 50 both fastening to the dielectric body 10.

Figure 2:
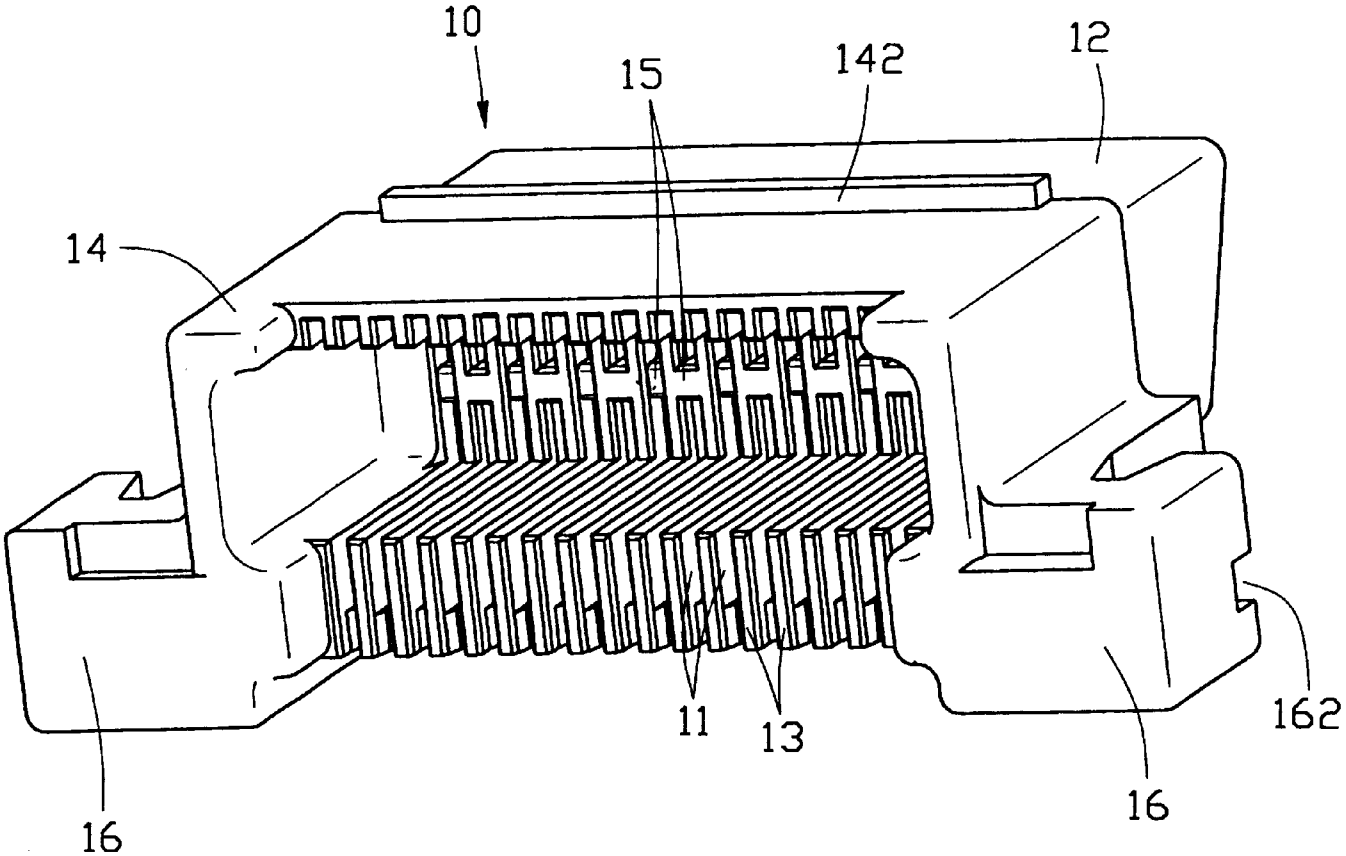
FIG. 2 is a perspective view of a dielectric body of the electrical connector of FIG. 1.
Figure 3:
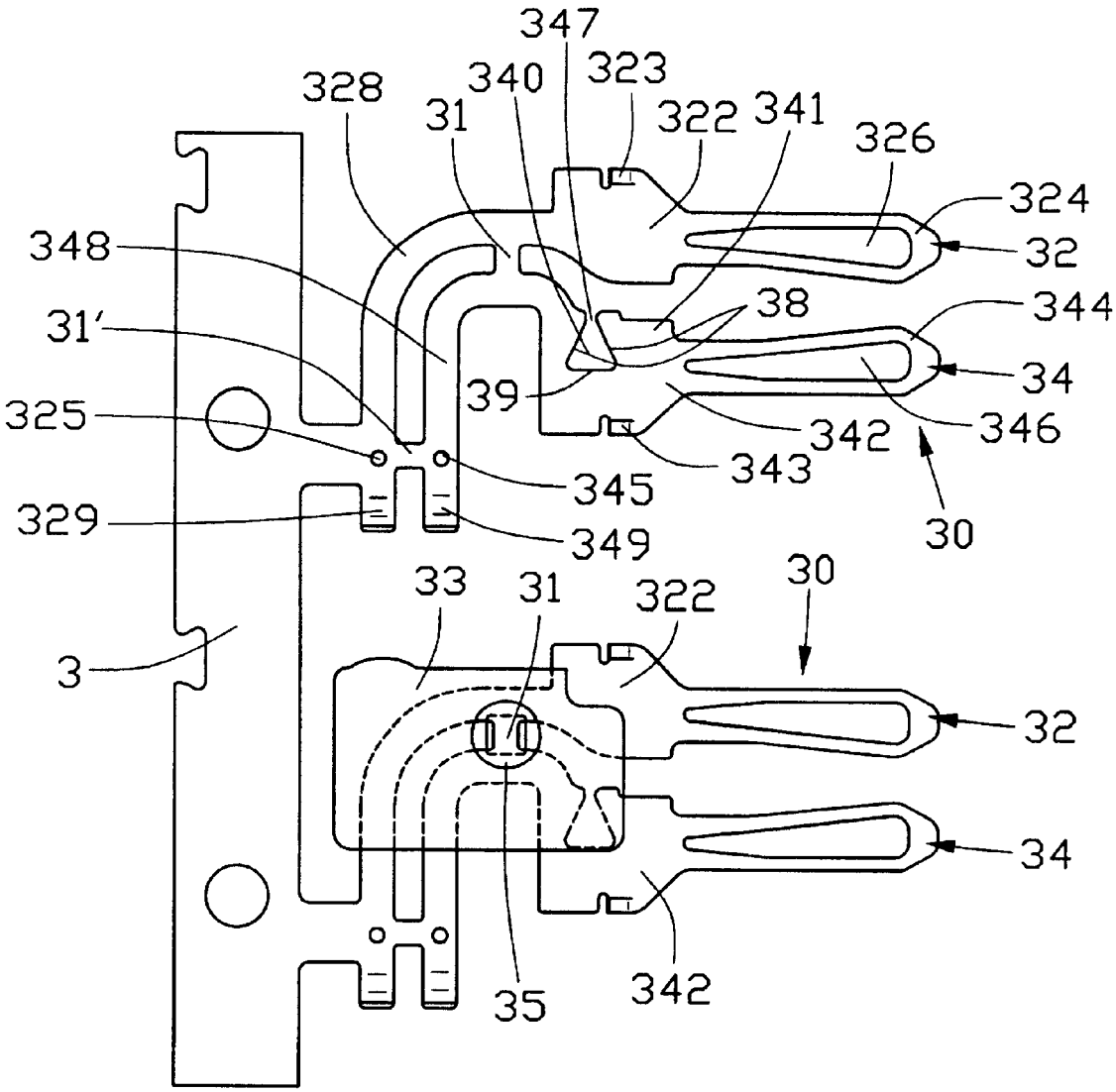
FIG. 3 is a planar view of signal contact units of the electrical connector in FIG. 1 wherein the signal contact units are connected with a contact strip during manufacturing.
Figure 4:
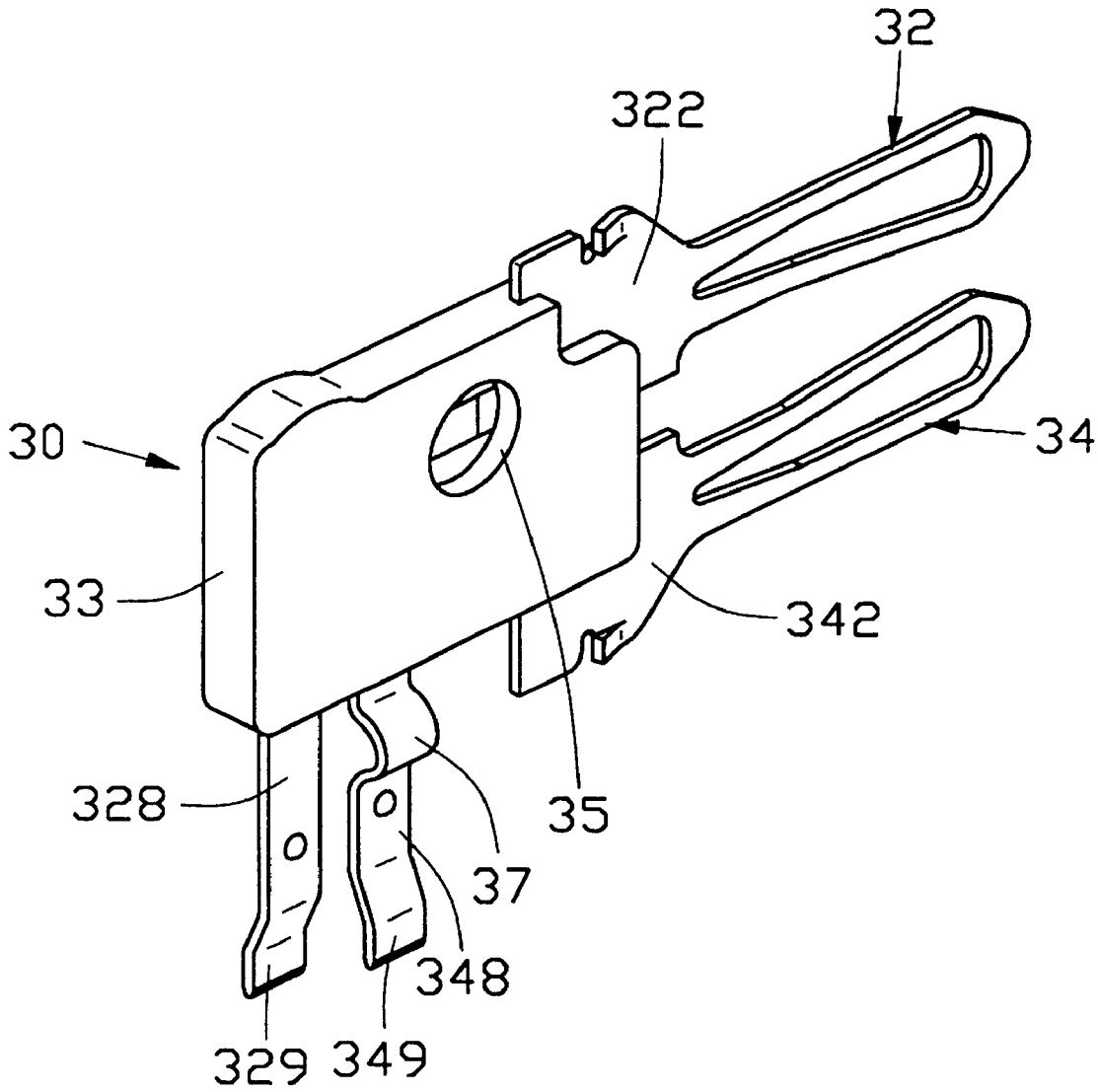
FIG. 4 is a perspective view of the finished signal contact unit of FIG. 3.
Figure 11:
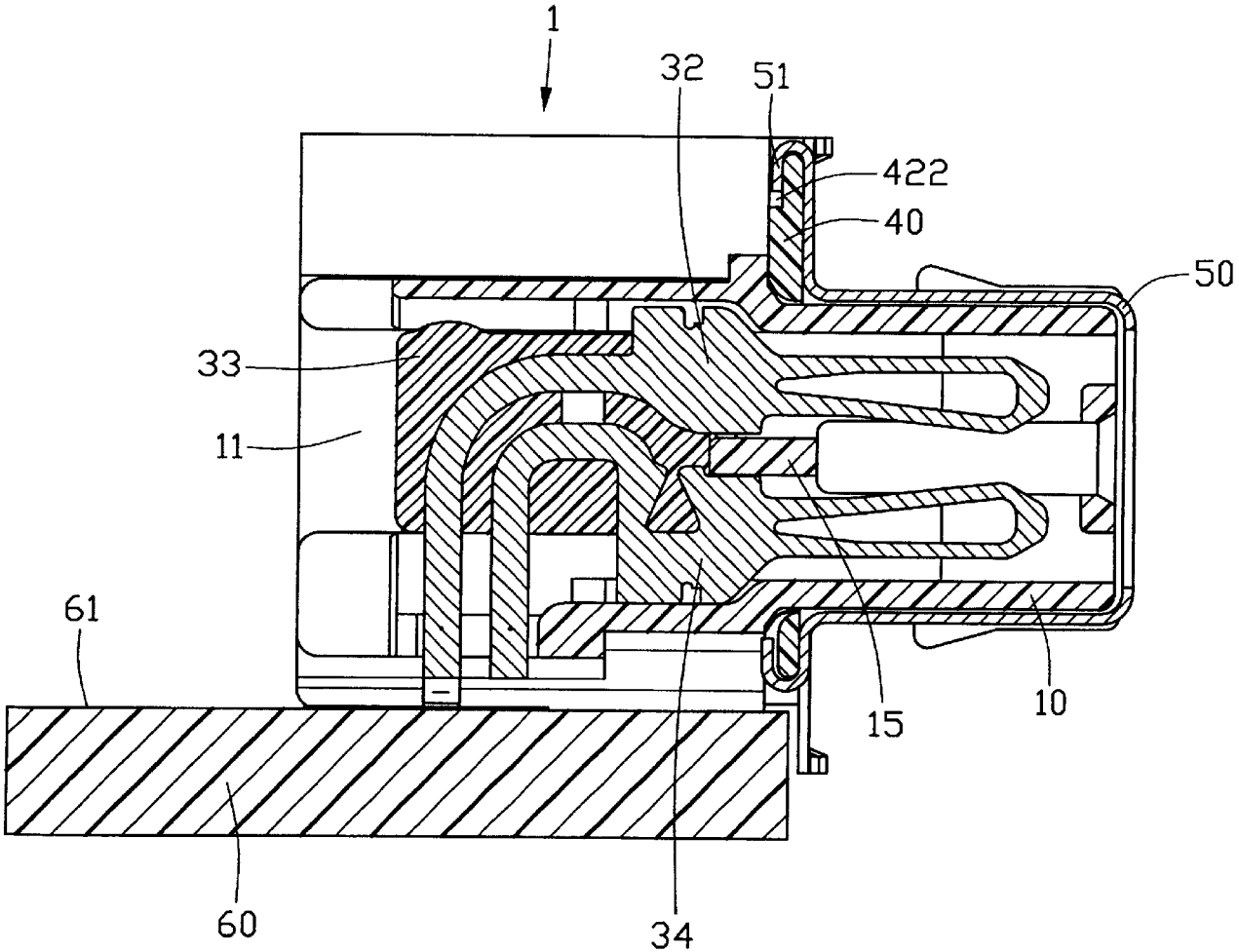
FIG. 11 is a cross-sectional view of FIG. 7.

Further referring to FIGS. 2 and 11, the dielectric body 10 includes a front portion 12 and a rear portion 14 extending rearward from the front portion 12. An elongate bar 142 is formed on a top face 144 of the rear portion 14 adjacent to the front portion 12. The dielectric body 10 defines a plurality of passageways 11 extending from the front portion 12 to the rear portion 14 and separated by a corresponding number of partitions 13. A number of retaining blocks 15 are integrally formed between every two adjacent partitions 13. Additionally, the rear portion 14 further includes a pair of wings 16 extending from opposite sides thereof and each wing 16 defines a cutout 162 in a font side thereof.

The frame member 40 includes a plate portion 42, a pair of side wings 46 extending rearward from a rear face 426 of the plate portion 42, and a pair of latches 48 extending forward from a front face 424 of the plate portion 42. The plate portion 42 defines an enlarged opening 44 for insertion of the front portion 12 of the dielectric body 10 and a pair of recesses 422 in each of the upper and lower sides (not labeled) thereof. Each retaining portion 46 forms a latching post 462 for insertion into a corresponding hole 62 defined in the circuit board 60, and a latching block 464 adjacent to the latching post 462 for latching with the cutout 162 of the dielectric body 10. Each latch 48 has a pair of barbs 482 on opposite top and bottom faces (not labeled) thereof.

The conductive shield 50 is adapted for covering on the front portion 12 inserted into the enlarged opening 44 of the frame member 40 and comprises a conductive plate 52 and a shroud 56 extending forward from the plate 52. The plate 52 forms a pair of hooks 51 and several grounding tabs 53 on each of the upper and lower sides thereof and defines a pair of apertures 55 in opposite sides thereof.

The grounding contact 20 comprise a body portion 22, a pair of hollow beams 24 extending forward from the body portion 22 for mating with a corresponding grounding terminal (not shown) of the mating component and a soldering tail 26 extending rearward from the body portion 22 for soldering to a corresponding grounding pad 64 alternately formed with the signal pad 66 on the circuit board 60.

Figure 6:
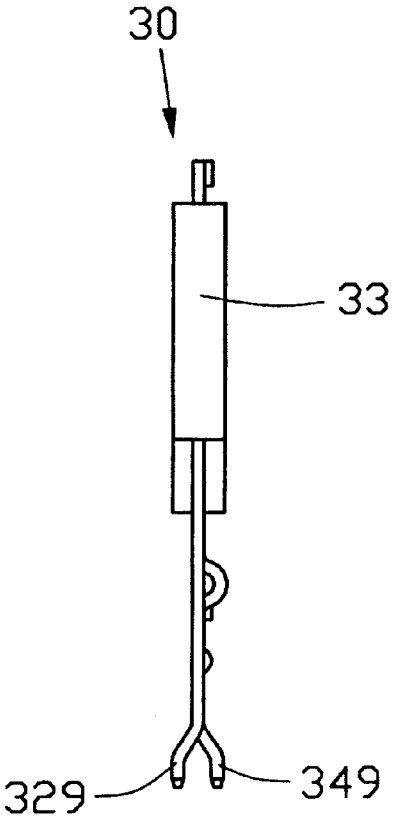
FIG. 6 is a side view of FIG. 4.
Figure 5:
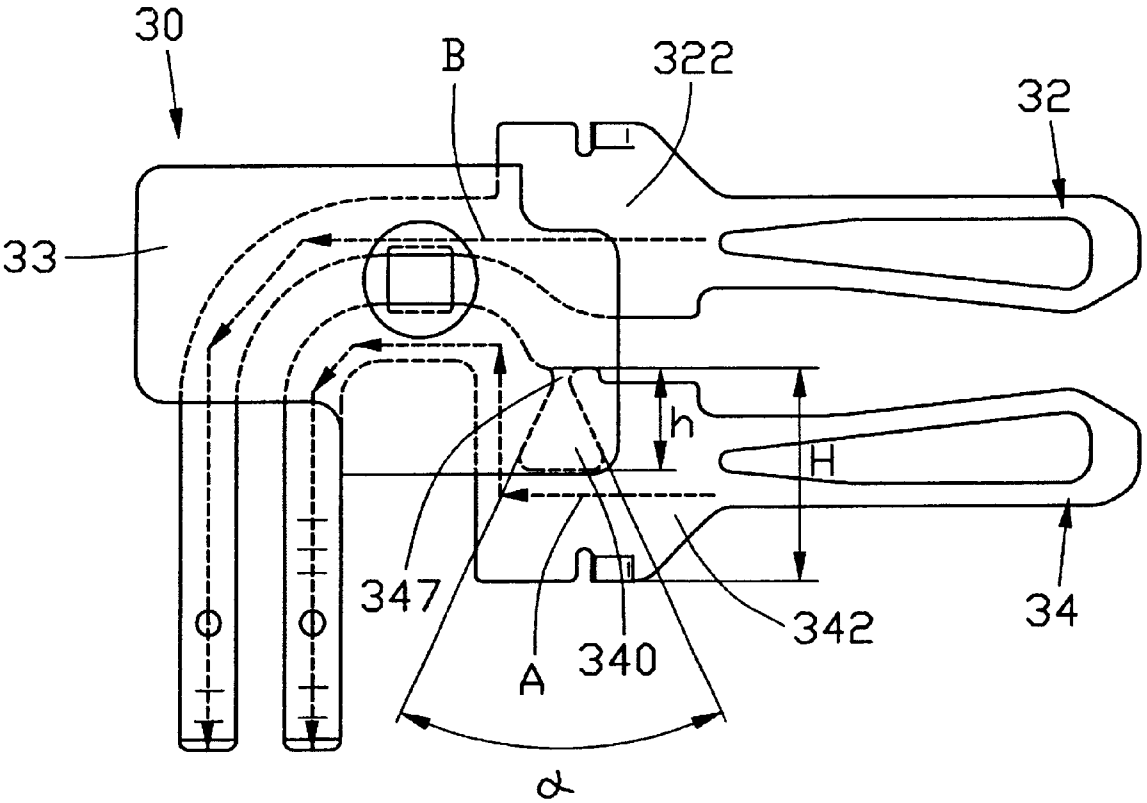
FIG. 5 is a front view of FIG. 4.
Figure 7:
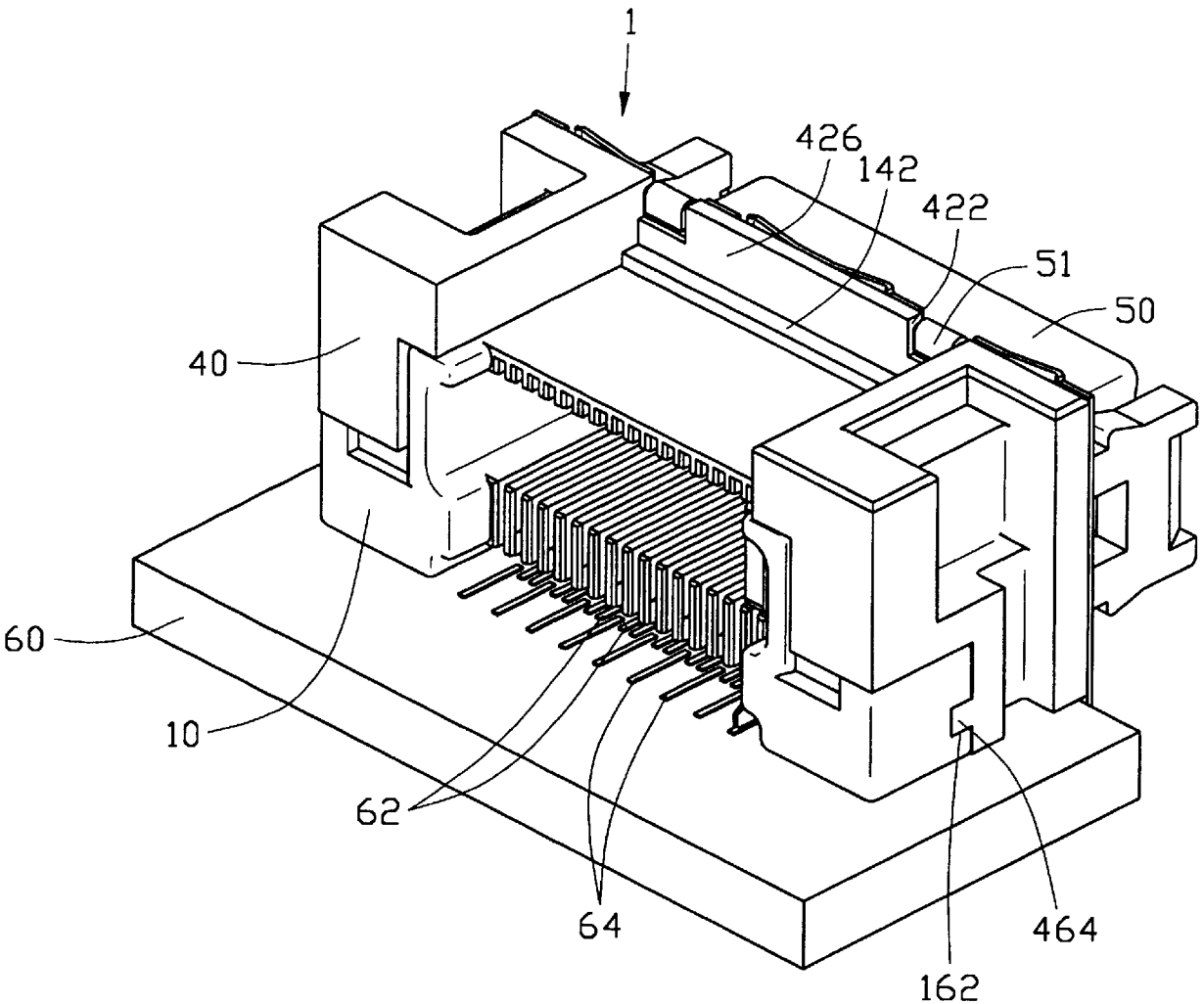
FIG. 7 is an assembled perspective view of FIG. 1.
Figure 8:
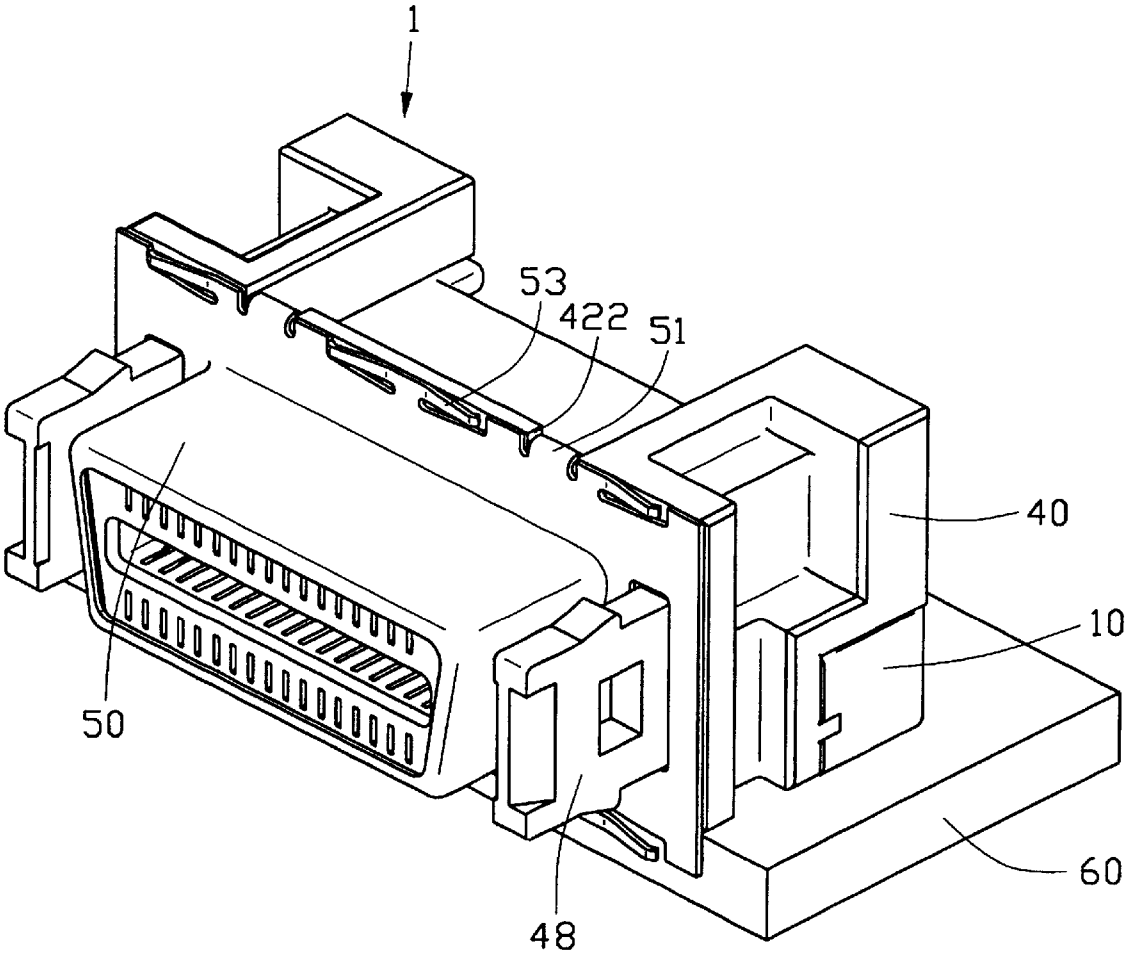
FIG. 8 is another assembled perspective view of FIG. 1.
Figure 9:
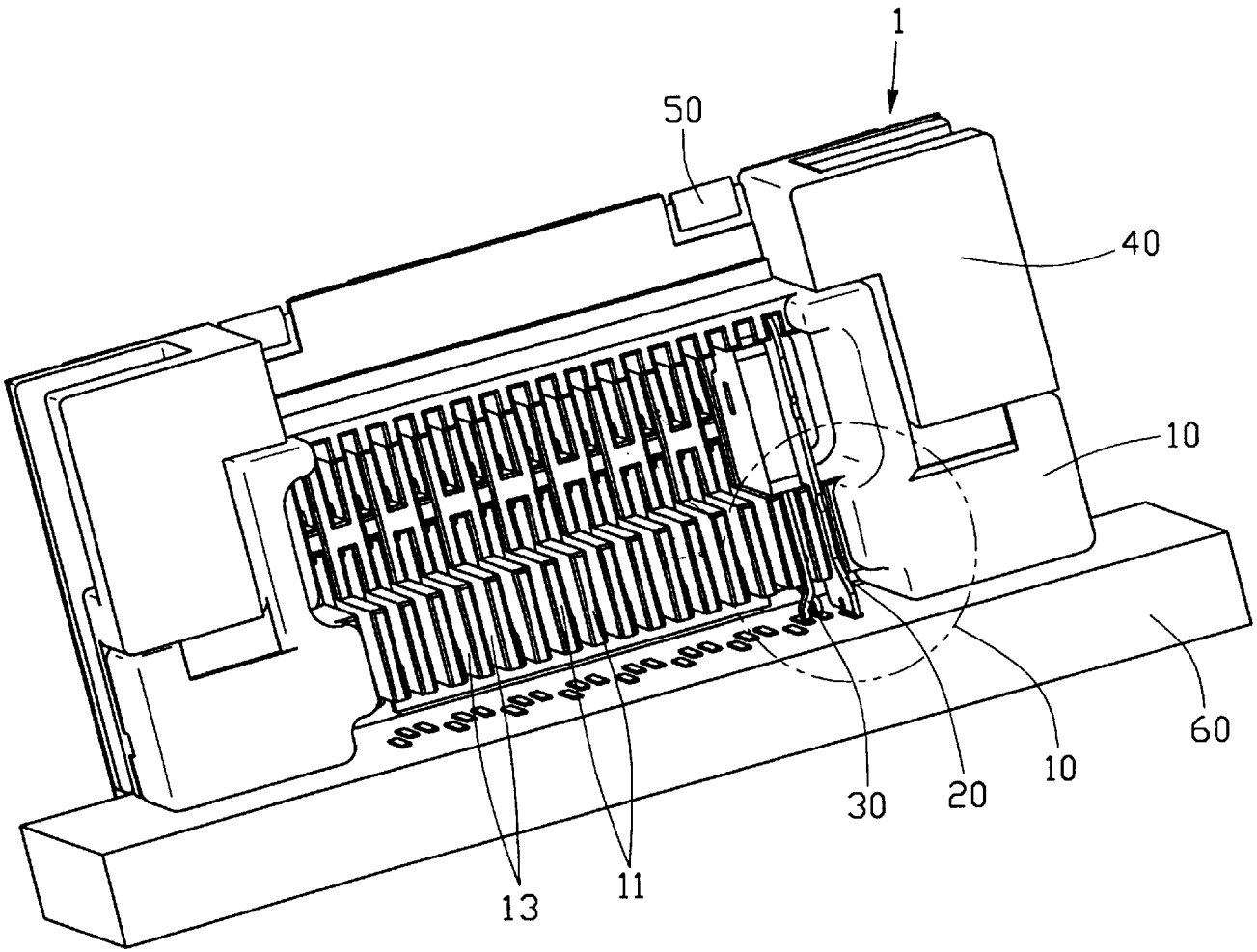
FIG. 9 is still another assembled perspective view of FIG. 1.
Figure 10:
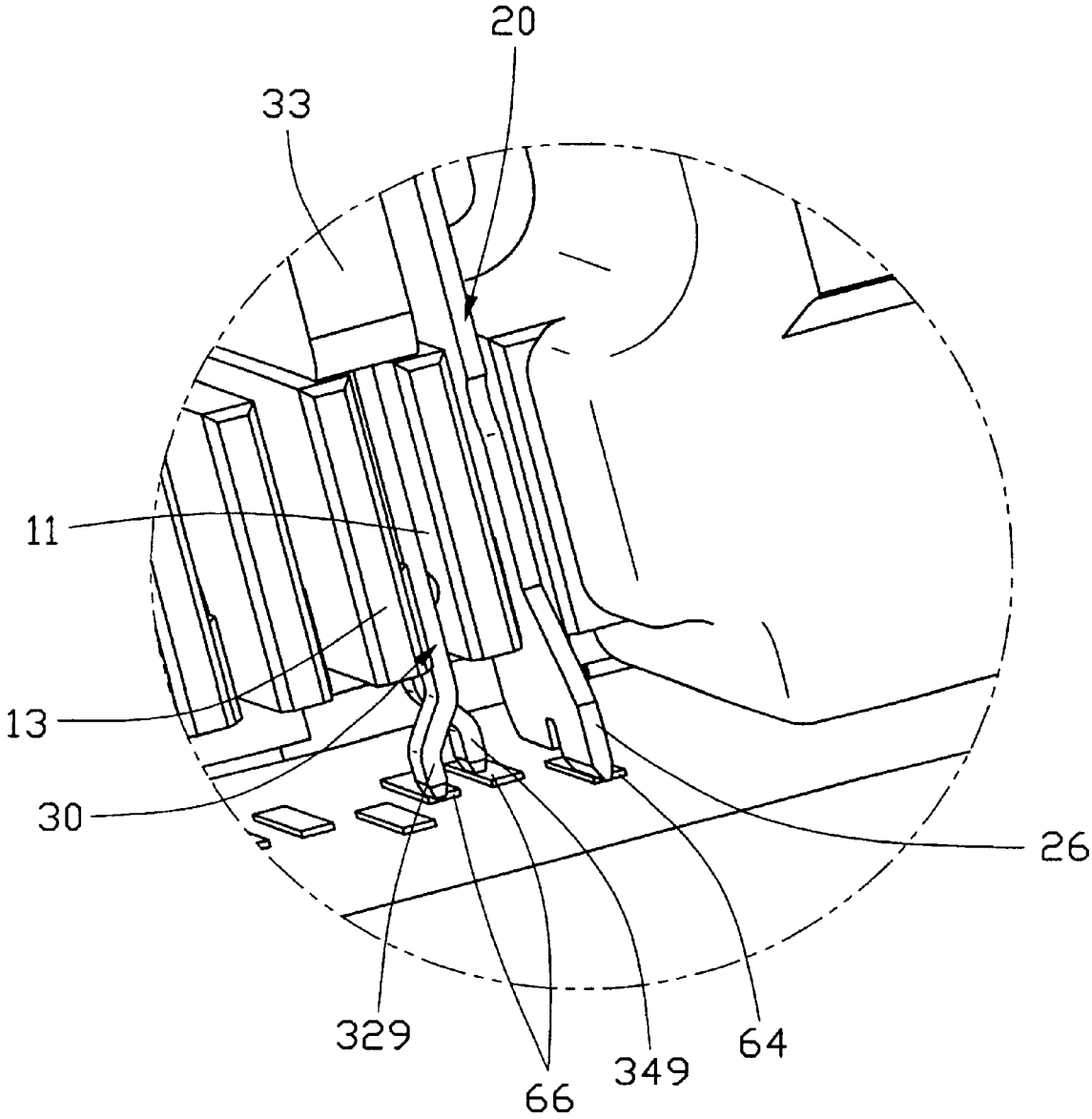
FIG. 10 is a partial enlarged view of FIG. 9.

Referring to FIGS. 3 to 6, the signal contact unit 30 in the preferred embodiment of the present invention has a differential pair of conductive contacts 32, 34 for transmitting high-speed and high-frequency differential signals between an electrical component (not shown) and the circuit board 60. A contact strip 3 is first stamped to form a plurality of contact units 30, and each contact unit 30 forms the pair of upper and lower contacts 32, 34 connected with each other by first and second linking tabs 31, 31'. The contact unit 30 is then insert-molded with a rectangular-shaped dielectric retainer 33, made of plastic or the like, for retaining the contact unit 30 into the dielectric body 10 with a round opening 35 left for exposing the first linking tab 31. Then, the first and second linking tabs 31, 31'are punched off and the contact strip 3 is cut off from the contact unit 30, thereby forming a completed contact unit 30, as shown in FIG. 6. The upper and lower contacts 32, 34 of the contact unit 30 are differential pair and the lower contact 32 is shorter than the upper contact 34 in its whole length. Each of the upper and lower contact 32, 34 comprises a relatively wider retaining portion 322 (342), a spring beam 324 (344) and a soldering portion 328 (348) extending from opposite ends of the retaining portion 322 (342), respectively. A pair of barbs 323 (343) and a pair of bumps 325 (345) are formed on the retaining portions 322 (342) and the soldering portions 328 (348), respectively, for retaining the signal contact unit 30 in the dielectric body 10. The spring beams 324, 344 are used to sandwich an inserted electrical component (not shown) therebetween and each defines an elongate slot 326 (346) substantially extending along the whole length thereof for increasing its resilience. The soldering portions 328, 348 respectively have soldering tails 329, 349 bending in opposite directions for soldering to a pair of corresponding signal pads 66 on the circuit board 60. The soldering portion 348 of the lower contact 34 further forms a crook portion 37 to be operated by a tool (not shown) during assembly for facilitating to assemble the contact unit 30 into the dielectric body 10. Furthermore, the retaining portion 342 of the lower contact 34 further defines a cutout, designated as a skew pocket 340 in an upper side 341 thereof and adjacent to the upper contact 32. The skew pocket 340 is substantially like an inverted funnel in cross section and is defined by a pair of slanted sides 38 and a bottom side 39 connected therebetween. The pair of sides 38 defines a top gap 347 at upper ends thereof and the top gap 347 can be as narrow as possible, as is permitted during manufacturing. As best seen in FIG. 5, in a preferred embodiment of the present invention, the ratio of the height "h" of the skew pocket 340 to the height "H" of the retaining portion 342 is about 0.475 and an angle "$\alpha$" defined by the pair of sides is about 50 degrees. Accordingly, a first electrical path through the lower contact 34, designated as "A", passes under the skew pocket 340 to increase the whole length thereof so that it is substantial equal to a second electrical path through the upper contact 32, designated as "B". Using this way, electrical skew between the upper and lower contacts 32, 34 is eliminated, and thus, propagation delay therebeteen is minimized or eliminated. Additionally, the upper and lower contacts 32, 34 are offset by a consistent distance at retaining and soldering portions 322, 342, 328, 348 thereof and the top gap 347 of the skew pocket 340 is as narrow as possible, as is permitted during manufacturing. Therefore, mismatched system impedance is minimized or eliminated. Thus, the differential pair of upper and lower contacts 32, 34 of the present invention can transmit reliable differential signals while maintaining the system impedance.

In assembly, referring to FIGS. 1, and 7 to 11, the grounding contacts 20 and the signal contact units 30 are inserted into corresponding passageways 11 from the back of the dielectric body 10, and the signal contact units 30 are under the help of the tool applying force on the crook portions 37 thereof. The retaining bodies 22 of the grounding contacts 20 and the retaining portions 322 (342) of the signal elements 30 are overridden on corresponding retaining blocks 15 of the dielectric body 10. The elongated retainers 33 of the signal contact units 30 are mounted on every two adjacent partitions 13 of the dielectric body 10 for safely positioning the contact units 30, as best seen in FIG. 11. The front portion 12 of the dielectric body 10 is then inserted through the opening 44 of the frame 40 till the elongated bar 142 abuts against a rear face 426 of the plate portion 42 and the cutout 162 is latched by corresponding latching blocks 464 of the frame member 40, respectively. Next, the conductive shield 50 is fastened to the frame member 40 with the apertures 55 thereof engaging with the latches 48 of the frame member 40, and the shroud 56 thereof covers onto the front portion 12 of the dielectric body 10. Additionally, the hooks 51 of the conductive shield 50 are fitted in corresponding recesses 422. The latching posts 462 of the frame member 40 are then inserted and soldered into corresponding holes 62 of the circuit board 60. Finally, the soldering sections 329 (349) of the signal contact units 30 and the soldering tails 26 of the grounding contacts 20 are soldered to corresponding signal and grounding pads 66, 64 of the circuit board 60, respectively.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector used for transmitting high speed signals between an electrical component and a circuit board, comprising:

a dielectric body defining a plurality of passageways; and a plurality of signal contact units being retained in the passageways of the dielectric body, each signal contact unit having a differential pair of upper and lower contacts separated from each other wherein the lower contact is shorter than the upper contact in total length, each of the upper and lower contacts comprising a retaining body, a resilient beam and a soldering portion extending from opposite ends of the retaining body, the retaining body of the lower contact defining a cutout in an upper side thereof adjacent to the upper contact; wherein the cutout of the lower contact is substantially shaped like an inverted funnel in cross section and is defined by a pair of lateral sides and a bottom side connecting the later sides, a first distance between upper ends of the lateral sides being shorter than a second distance between lower ends of the lateral sides; and wherein a first electrical path through the lower contact passes under the cutout for increasing an effective length thereof to be substantial equal to a second electrical path through the upper contact.

2. The electrical connector as claimed in claim 1, wherein the upper and lower contacts are offset from each other with a substantially consistent distance at retaining portions and soldering portions thereof.

3. The electrical connector as claimed in claim 1, wherein each grounding contact comprises a retaining portion, a pair of mating arms extending from one end of the retaining portion for mating with a corresponding grounding terminal of the electrical component, and a soldering tail extending from another end opposite to the one end of the retaining portion for soldering to a corresponding grounding pad alternately arranged with the signal pads on the board.

4. The electrical connector as claimed in claim 1, further comprising a frame member attached to the dielectric body, the frame member defining an opening for insertion of the dielectric body.

5. The electrical connector as claimed in claim 1, further comprising a conductive shield covering on the dielectric body.

6. The electrical connector as claimed in claim 1, wherein the retaining bodies of the upper and lower contacts from barbs on outer sides thereof for being retained in the dielectric body.

7. The electrical connector as claimed in claim 6, wherein the resilient beam defines an elongate slot.

8. The electrical connector as claimed in claim 1, wherein the soldering portions of the upper and lower contacts respectively comprise soldering sections offset from a plane on which the signal contact unit lies for soldering to corresponding signal pads formed on the circuit board.

9. The electrical connector as claimed in claim 8, wherein a dielectric retainer is integrally molded with the upper and lower contacts of each signal contact unit and retains to the passageway of the dielectric body.

10. The electrical connector as claimed in claim 1, wherein the passageways of the dielectric body extend through opposite front and rear faces of the dielectric body and a plurality of partitions separate the passageways from one another.

11. The electrical connector as claimed in claim 10, wherein a retaining block is integrally formed between every two adjacent partitions.

12. An electrical contact unit used for transmitting high speed and high frequency signals between an electrical component and a circuit board, comprising a pair of upper and lower contacts separated from each other for transmitting differential signals, each of the upper and lower contact having a retaining body, a resilient beam contacting with the electrical component and a soldering portion soldered to a circuit board extending from opposite ends of the retaining body, the retaining body of the lower contact defining a cutout in an upper side thereof adjacent to the upper contact; wherein a first electrical path through the lower contact passes under the cutout for increasing an effective length thereof to be substantial equal to a second electrical path through the upper contact.

13. The electrical connector as claimed in claim 12, wherein the cutout of the lower contact is substantially shaped like an inverted funnel in cross section and is defined by a pair of lateral sides and a bottom side connecting the later sides, a first distance between upper ends of the lateral sides being shorter than a second distance between lower ends of the lateral sides.

14. The electrical contact unit as claimed in claim 12, wherein the upper and lower contacts are offset from each other with a substantially consistent distance at retaining portions and soldering portions thereof.

15. The electrical contact unit as claimed in claim 12, wherein a dielectric retainer is integrally molded with the upper and lower contacts.

16. An electrical contact unit comprising:

a pair of upper and lower contacts generally located in a common plane; and the upper contact and the lower contact having retaining portions and spring beams in a parallel manner; wherein to equalize electrical paths of both the upper and lower contacts, a portion of the retaining portion of the lower contact adjacent to an joined portion between a corresponding solder portion and the retaining portion thereof is removed to increase the electrical path therebetween, and a crook portion is formed on the solder portion of the lower contact to increase the electrical path thereof.

17. The contact unit as claimed in claim 16, wherein said crook portion extends laterally away from said common plane.

* * * * *